United States Patent [19]

Moustakas

[11] 4,032,144

[45] June 28, 1977

[54] FISHING GAME

[75] Inventor: Matthew A. Moustakas, Mercerville, N.J.

[73] Assignee: CBS Inc., New York, N.Y.

[22] Filed: May 3, 1976

[21] Appl. No.: 682,209

[52] U.S. Cl. ..... 273/86 R; 273/1 R

[51] Int. Cl.[2] ..... A63F 9/14

[58] Field of Search ..... 273/86 R, 86 E, 95 AA, 273/1 R; 46/132

[56] References Cited

UNITED STATES PATENTS

| | | | |
|---|---|---|---|
| 3,589,724 | 6/1971 | Barlow et al. | 273/1 R |
| 3,643,947 | 2/1972 | Collins | 273/86 E |
| 3,893,256 | 7/1975 | Wolf et al. | 273/95 AA X |

FOREIGN PATENTS OR APPLICATIONS

| | | | |
|---|---|---|---|
| 246,698 | 2/1926 | United Kingdom | 273/86 E |

*Primary Examiner*—Anton O. Oechsle
*Attorney, Agent, or Firm*—Spencer E. Olson

[57] ABSTRACT

A game to be played by two persons in competition or by one person against time, the game apparatus including a base member simulative of a boat on which is supported a vertical mast structure having a plurality of crossarms projecting outwardly at various levels, two pairs of strings which are tethered at one end to the top of the mast and each string having a hand grip at its other end, a pair of rings each surrounding one pair of the strings and having a hook secured thereto, and a plurality of game pieces each simulative of a fish and having an aperture for receiving the hook. The game pieces are removably supported in an upright position on the base member, half of them on either side of the mast, to be engaged by a corresponding hook. The object of the game, when played in competition, is to be the first player to hang one of his fish on each of the crossarms by grasping the handgrips and manipulating the strings to engage one of the fish on the hook, raising the fish by pulling the strings apart to line it up with a crossarm on the mast, and returning the hook by bringing the strings together, to engage another fish.

10 Claims, 3 Drawing Figures

FISHING GAME

BACKGROUND OF THE INVENTION

This invention relates to a game of skill, and, more particularly, to a game in which game pieces are moved from one position to another, primarily upwardly and downwardly, by manipulation of a pair of tethered strings.

The concept of utilizing a pair of strings attached at one end to a suitable support at a level higher than the position of the operator wherein separation of the strings by the operator causes an article, such as a toy aircraft through which the pair of strings pass, to travel uphill along the strings, has been known in the prior art as exemplified by U.S. Pat. Nos. 1,676,989 and 3,893,256. In the latter patent, the strings are attached to a wall, for example, at a point above the head of the operator and pass through the body of a toy aircraft. When the strings are separated by grasping handles on the free ends of the strings, the aircraft is caused to move uphill along the strings, and when the strings are again brought together, the aircraft travels back down along the strings at a rate controllable by the amount of separation of the handles. In these patents, the concept is embodied in a toy, usable by a single person, and involves manipulation of the strings solely for the purpose of causing a toy aircraft to move up and down along the strings to simulate the flight of an aircraft; that is, the degree of manipulative dexterity required to control the movement of the aircraft is minimal, and being strictly an entertainment device, it does not encourage the improvement of manipulative skills, nor does it afford an opportunity for competitiveness, either against time or against another player.

SUMMARY OF THE INVENTION

It is a primary object of the present invention to provide a game which can be played by two persons in competition, or by one person against time, which is both entertaining and useful in the development of manipulative skills. Another object of the invention is to provide a game which is simulative to the sport of deep sea fishing and in which the skill of the opposing players largely determines the outcome of the game.

The game has an educational value in that it makes for the proper coordination of eye and hands and the skill which may be developed, by practice, makes the game interesting to both children and adults.

Briefly, the game apparatus includes a base member on which is supported a vertical mast structure having a plurality of crossarms projecting outwardly therefrom at various levels, two pairs of lines which are tethered at one end to the top of the mast and each having a handgrip attached to the other end, a pair of rings provided with a hook, each surrounding one pair of the strings, and a plurality of game pieces, each having an aperture for receiving the hook and for engaging a crossarm. The game pieces are removably supported in an upright position on the base member, half of them on either side of the mast, to be engaged by the hook on a corresponding one of the rings. The ring is caused to travel up and down along its associated string by pulling the strings apart or moving them together, the object of the game being to be the first player to move his game pieces from their rest position and hang them one on each of the crossarms.

BRIEF DESCRIPTION OF THE DRAWINGS

The above and other objects and features of the invention will become more apparent, and its construction and operation better understood, from the following detailed description of a preferred embodiment, taken in conjunction with the accompanying drawings, in which.

DESCRIPTION OF THE PREFERRED EMBODIMENT

Figure 3:
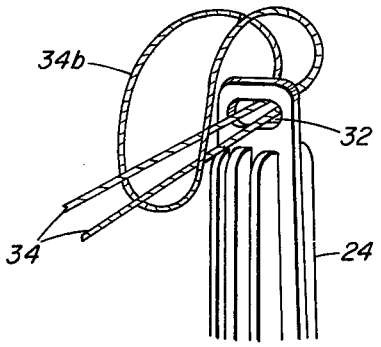
Figure 1:
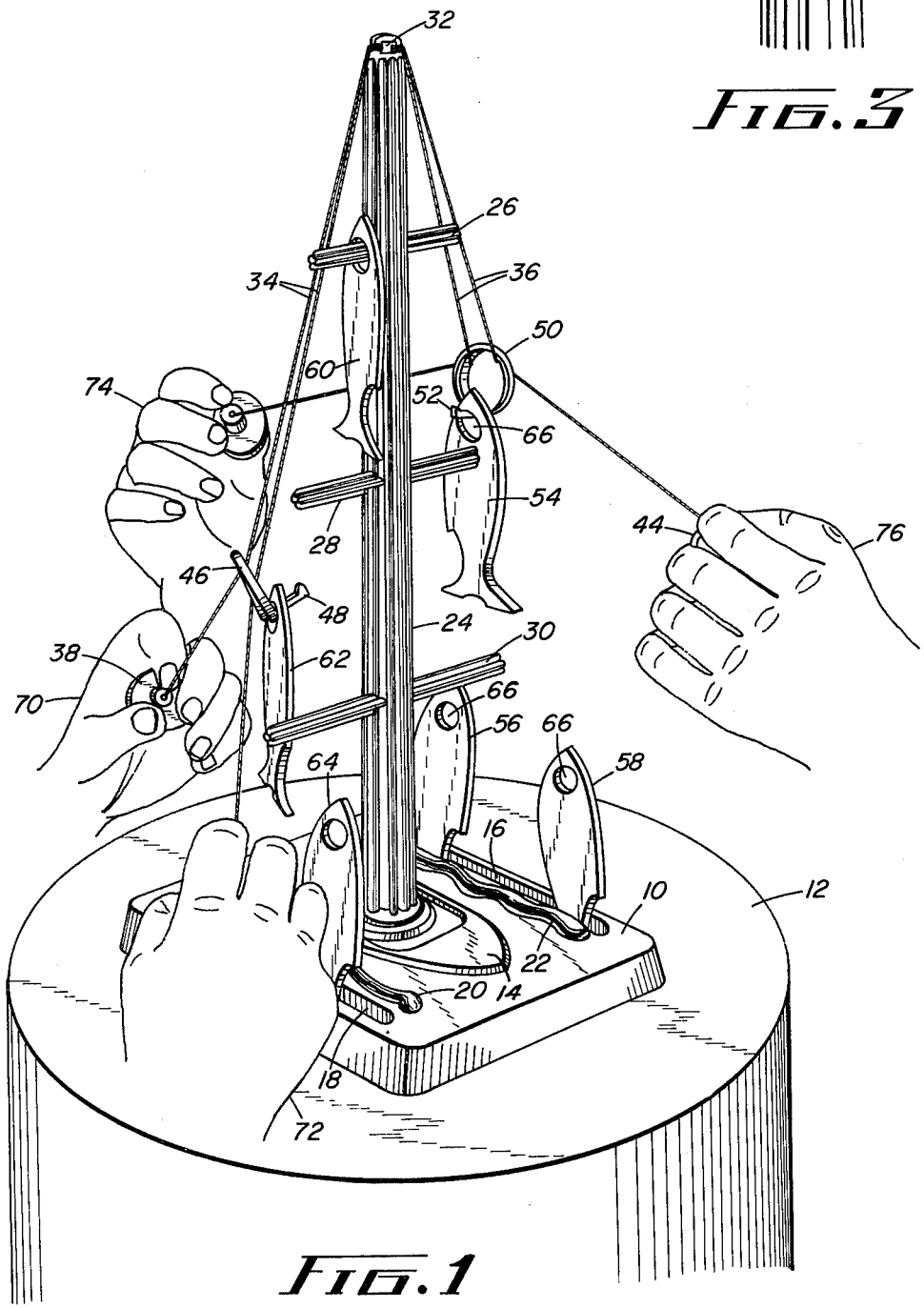
FIG. 1 is a perspective view of a game in accordance with this invention.

Referring now to FIG. 1, the game apparatus comprises a base member 10 having a flat undersurface so as to stably supported on a table 12 or other supporting surface. The upper surface of the base member is formed to simulate the hull 14 of a boat, and on either side of the boat has elongated, narrow slots 16 and 18 formed therein. Surrounding the boat, the upper surface has wavy raised portions 20 and 22 simulative of waves on water. The base member 10 is preferably molded in one piece from a suitable plastic material, and better to simulate the effect of a boat in the water, may be blue in color. The base member has an opening therein at a position centrally of the cockpit of the boat 14 in which the lower end of an elongated member 24 simulative of a mast is received and supported in a vertical position. The mast has three crossarms projecting outwardly on either side of the mast at different levels and in a direction perpendicular to the longitudinal axes of slots 16 and 18, a top crossarm 26, a middle crossarm 28 and a lower crossarm 30, of progressively greater length. The mast and crossarms are preferably molded as an integral piece from a suitable plastic material, preferably of a color contrasting with that of the base member 10 to enhance the simulation of a real-life fishing boat. The exterior surface of the mast may be flute as shown, particularly in FIG. 3, to increase its resistance to bending and to enhance its appearance.

Figure 2:
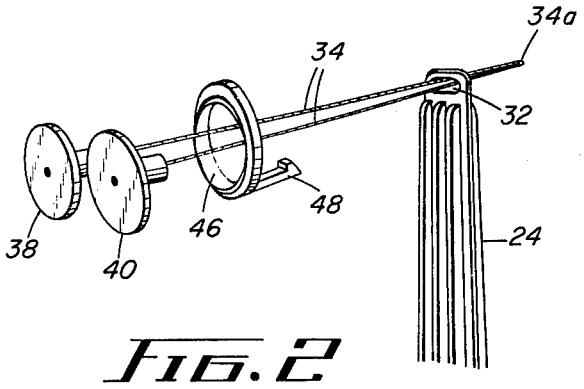
FIGS. 2 and 3 are fragmentary perspective views of the upper end of the mast, illustrating how the strings are tethered to the mast.

At its upper end the mast 24 has an oval-shaped aperture 32 formed therein to facilitate tethering to the top of the mast of two pairs of lines or strings 34 and 36. Each of the pairs of lines may consist of a single line which is folded in half as at 34a in FIG. 2, inserted through the aperture 32, and the free ends of the two lines passed through the loop 34b (FIG. 3) and pulled taut, thereby to secure the two lines to the mast. The other pair of lines 36 are similarly secured to the top of the mast. Each of the strings is sufficiently long that when hanging free alongside the mast, its lower end almost reaches the upper surface of the base member 10. To the free ends of each of the strings of pair 34 are attached handgrips 38 and 40, and the strings of pair 36 likewise have handgrips 42 and 44 attached to their free ends. The handgrips may take the form of a disc having an integral concentric cylinder extending from one surface thereof, and having a central opening therethrough for receiving the string and being attached thereto simply by knotting the end of the string.

The strings of pair 34 pass through an annular ring 46, the inner diameter of which is slightly less than the diameter of the handgrips. Integrally joined to the ring 46 is a hook 48 which projects from one surface of the ring in a direction parallel to the axis of the ring; the ring is assembled with the strings of pair 34 such that the hook 48 extends toward the mast 24. Similarly, the strings of pair 36 pass through a second ring 50 which has an integral hook 52 extending toward the mast. The rings and their associated hooks are preferably molded in one piece from a suitable plastic material.

Completing the game apparatus is a plurality of game pieces, six in the illustrated embodiment, in the form of fish 54, 56, 58, 60, 62 and 64, preferably formed of a suitable plastic sheet material having an outlime simulative of a fish. Each has an aperture 66 therein, generally at the locatin of the eye of a real fish, of a diameter sufficiently large to receive at the same time, with a small amount of clearance, the hook on the ring and a crossarm of the mast. To distinguish one player's game pieces from those of the other, three of the fish preferably are of a different color than the other three. The thickness of the game pieces is so related to the width of slots 16 and 18 that the fish may be supported on their tails in an upright position in the slots, three on either side of the mast. This is the rest position of the game pieces prior to the start of game play.

The object of the game, which normally is played by two persons in competition, is to be the first player to hang one of his three fishes on the top crossarm 26, one on the middle crossarm 28, and the third on the crossarm 30, solely by manipulation of his pair of lines; that is, without touching the game pieces with hand or body. With each player's fish lines by in the slot nearest him, each attempts by manipulation of his handgrips to maneuver his ring and hook into position to pass the hook through the aperture 66 in one of his fish, and after "catching" one, pulling the lines apart to cause the ring and engaged fish to be raised up along the pair of lines to a level where the under surface of the hook is lined up with the upper surface of the upper crossarm 26. The pair of strings or lines are then maneuvered toward the mast 24 to cause the crossarm 26 to enter the aperture 66, whereupon the ring is dropped slightly, by bringing the strings together slightly, to free the hook and thereby allow the fish to be supported on the crossarm. Next, the strings are carefully drawn back away from the mast so as not to dislodge the fish from the crossarm. The ring is then lowered by bringing the lines together, which allows the ring under the force of gravity to slide down along the lines. The process is repeated for the remaining two fish, except that one of them is placed on the middle crossarm and the last is placed on the bottom crossarm. In the illustration of FIG. 1, the player at the left, whose hands are shown at 70 and 72, has already placed his first fish 60 on the upper crossarm 26 and is proceeding to line up his second fish 62 with the middle crossarm 28, whereas the player on the right, whose hands are indicated at 74 and 76, is maneuvering his first fish 54 toward the upper crossarm 26.

It will be evident from the foregoing that to quickly transfer the game pieces from their rest position to the three goal positions requires a high degree of coordination between eyes and hands, and a controlled finger touch on the handgrips with which the lines are manipulated. It is a skill that can be improved with practice (which can be done by one person playing alone); thus, one is encouraged to improve his skill, better to complete in his next encounter with an opposing player. A child of about four can be expected to develop sufficient dexterity to play the game, yet it is sufficiently challenging that children of all ages, including adults, can find it entertaining, either alone or in competition with an opposing player.

Although the invention has been described with respect to a specific preferred embodiment thereof, many variations and modifications will now become apparent to those skilled in the art. For example, although the components of the game apparatus have been described as being formed of molded plastic material, primarily for reasons of economy of manufacture and durability of the finished product, the inventive concept can be readily embodied in game apparatus formed of wood, or of metal, or of a combination of wood, metal and plastic. Likewise, although the invention has been described as being embodied in a fishing game, the game pieces may be other than replicas of fish, or the vertical member and its crossarms simulative of environments other than the mast of a boat. It is therefore the intention that the appended claims be interpreted as broadly as possible in view of the prior art to include all such variations and modifications.

I claim:

1. Game apparatus comprising, in combination:

a base member adapted to be supported on an underlying surface and having at least one elongated slot formed in the upper surface thereof, an elongated member vertically supported on said base member, said vertical member having at least one crossarm extending outwardly therefrom, a pair of lines each tethered at one end to the upper end of said vertical member and each having a handgrip attached to the other end, an annular ring member through which both lines of said pair extend, said ring member having a hook secured thereto, and at least one game piece having an aperture therethrough sufficiently large to receive at the same time said hook and said crossarm, said game piece being removably supported in said slot in a position to be engaged by said hook and adapted to be moved with said ring member along said pair of lines by separation and convergence of said lines.

2. Game apparatus according to claim 1, wherein the upper surface of said base member has two longitudinal slots formed therein on opposite sides of said vertically supported member, wherein at least one of said game pieces is removably supported in each of said longitudinal slots, wherein a second pair of lines, each having a handgrip attached to one end, is tethered at the other end to the upper end of said vertical member, and wherein a second ring member having a hook secured thereto surrounds said second pair of lines.

3. Game apparatus according to claim 1, wherein the upper surface of said base member is shaped to simulate the hull of a boat, and wherein said vertically supported member is shaped to simulate the mast of a boat having a plurality of crossarms projecting outwardly therefrom, each at a different height above the base member.

4. Game apparatus according to claim 2, wherein the upper surface of said base member is shaped to simulate the hull of a boat, wherein said vertically supported member is shaped to simulate a mast having a plurality of crossarms projecting outwardly therefrom, each of said crossarms being at a different level, and wherein said game pieces are shaped to simulate a fish.

5. Game apparatus according to claim 4, wherein three game pieces are removably supported in each of said longitudinal slots, the three game pieces for one slot being distinguishable from the three game pieces for the other slot.

6. Game apparatus according to claim 5, wherein said slots are substantially parallel to each other, and outline location wherein said vertically supported member has three crossarms of different lengths projecting outwardly in a direction substantially perpendicular to the long dimension of said slots.

7. Game apparatus according to claim 6, wherein the uppermost of said crossarms is shortest and projects outwardly from said vertically supported member at a point below the upper end thereof and the other two crossarms are progressively longer.

8. Game apparatus according to claim 4, wherein said game pieces are formed of flat plastic material, wherein said apparatus is so located on the game piece as to be simulative of the eye of a fish.

9. Game apparatus according to claim 1, wherein said annular ring and hook are integrally formed of plastic material, and said hook projects from an edge of the ring in a direction generally parallel to the axis of the ring and toward said vertically supported member.

10. Game apparatus according to claim 1, wherein said vertically supported member and said base member are each formed of molded plastic material.

* * * * *

UNITED STATES PATENT AND TRADEMARK OFFICE

CERTIFICATE OF CORRECTION

PATENT NO. : 4,032,144
DATED : June 28, 1977

INVENTOR(S) : MATTHEW A. MOUSTAKAS

It is certified that error appears in the above-identified patent and that said Letters Patent are hereby corrected as shown below:

Col. line 19, -- be -- should be inserted after "to".

Col. 2, line 42, "flute" should be -- fluted --.

Col. 3, line 11, "outlime" should be -- outline --.

Col. 3, line 30, "lines by" should be -- lined up --.

Col. 3, lines 65 and 66, "complete" should be -- compete --.

Col. 5, line 10, "outline location" should be deleted.

Col. 6, line 6, "apparatus" should be -- aperture --.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*